US006213681B1

(12) United States Patent
Sick et al.

(10) Patent No.: US 6,213,681 B1
(45) Date of Patent: Apr. 10, 2001

(54) SOIL COMPACTING DEVICE WITH ADJUSTABLE VIBRATION PROPERTIES

(75) Inventors: Georg Sick, Feldafing; Michael Steffen, Gauting; Thomas Maurer, München; Thomas Reiter, Erding; Franz Riedl, München, all of (DE)

(73) Assignee: Wacker-Werke GmbH & Co., KG (DE)

( * ) Notice: Subject to any disclaimer, the term of this patent is extended or adjusted under 35 U.S.C. 154(b) by 0 days.

(21) Appl. No.: 09/423,234

(22) PCT Filed: Jul. 16, 1998

(86) PCT No.: PCT/EP98/04441

§ 371 Date: Nov. 2, 1999

§ 102(e) Date: Nov. 2, 1999

(87) PCT Pub. No.: WO99/05362

PCT Pub. Date: Feb. 4, 1999

(30) Foreign Application Priority Data

Jul. 23, 1997 (DE) ..... 197 31 731

(51) Int. Cl.[7] ..... E01C 19/30

(52) U.S. Cl. ..... 404/133.05; 404/102; 404/84.1; 404/84.05; 405/271; 74/88; 366/116

(58) Field of Search ..... 405/271; 404/84.05, 404/84.1, 102, 114, 120, 133.05; 74/88; 366/111, 112, 116; 73/573, 579, 594

(56) References Cited

U.S. PATENT DOCUMENTS

| | | | | |
|---|---|---|---|---|
| 3,727,890 | * | 4/1973 | Seidl et al. | 366/116 |
| 3,756,735 | | 9/1973 | Linz | 404/133 |
| 3,834,827 | * | 9/1974 | Linz | 404/133.05 |
| 3,923,412 | * | 12/1975 | Linz | 404/133.05 |
| 4,149,253 | * | 4/1979 | Paar et al. | 404/84.05 |
| 4,722,635 | * | 2/1988 | Schnell | 404/102 |
| 5,164,641 | * | 11/1992 | Quibel et al. | 404/117 |
| 5,387,370 | | 2/1995 | Tomizawa et al. | 252/299.01 |
| 5,547,049 | | 8/1996 | Weiss et al. | 188/267 |

FOREIGN PATENT DOCUMENTS

| | | | | |
|---|---|---|---|---|
| 1168350 | | 4/1964 | (DE) . | |
| 4340699A1 | * | 6/1995 | (DE) | E02D/3/046 |

* cited by examiner

*Primary Examiner*—Eileen D. Lillis
*Assistant Examiner*—Alexandra K. Pechhold
(74) *Attorney, Agent, or Firm*—Boyle Fredrickson Newholm Stein & Gratz S.C.

(57) ABSTRACT

A soil compacting device has a damping system which couples an upper mass and a lower mass together with a spring system in a vibration system. The damping properties of the damping system can be modified while the device is in operation. Therefore, when the soil compacting device passes over soils having different properties, it can constantly be adjusted in an optimal manner to the ground underneath it by acting on the vibration properties of the overall vibration system.

16 Claims, 1 Drawing Sheet

SOIL COMPACTING DEVICE WITH ADJUSTABLE VIBRATION PROPERTIES

BACKGROUND OF THE INVENTION

1. Field of the Invention

The invention relates to a soil compacting device.

2. Description of the Related Art

Vibratory tampers, vibrating plates or vibrating rollers are generally used for soil compaction. Whereas tampers are displacement-excited vibratory systems with a large amplitude, vibrations in the case of vibrating plates are produced by means of force excitation. For reasons connected with the excitation of vibrations in the soil particles, guideability and to protect the operator against unwanted body vibrations, vibrating plates are often designed in such a way that they have a relatively high frequency (40 to 80 Hz) and a small amplitude of the vibrating base plate. From the category of vibrating rollers, trench rollers are generally used for soil compaction, in which vibrations are produced by rotating unbalanced weights within the facings or on the chassis forming a lower mass.

When using vibrating plates, in particular, on moist soils (what are referred to as cohesive soils with a high water content or saturated soils), such as silts and clays, that is to say fine-particle soils with little tendency toward water permeability, there is the problem that the soils can only be compacted to a limited extent by the action of vibrations. This is due to the fact that the cohesion which is often typical of cohesive soils affects the adhesion of the individual particles to one another and hence prevents repositioning of the particles. In the case of vibrating plates, the small amplitude of the vibrating base plate in conjunction with the high frequency leads to a further supersaturation of the soil with water, making the latter softer and more plastic in terms of vibration and causing its adhesive effect on the vibrating plate to increase. As a result, the vibrating plate may sink into the soft earth and no longer be capable of being moved along. In practice, this has led to vibrating plates not being used in damp weather or on saturated cohesive soils even though the soil compaction and surface quality that can be achieved by means of vibrating plates are highly regarded.

In practice, however, there is frequently the problem that, although the vibrating plates are used primarily only on non-cohesive soils, it is necessary for them at certain points to cross supersaturated cohesive soils which are likewise situated in the area to be compacted. In this case, the vibrating plates run the risk of sinking in or digging themselves in due to their natural vibration as they cross these points.

DE-B 11 68 350 has disclosed a vibration device for compacting the construction site with a vibratory plate. The vibratory plate is attached by springs to a road roller, between the front roller drum and the rear wheels. To increase the contact pressure of the vibratory plate on the ground, hydraulic cylinders are provided, these hydraulic cylinders pressing the springs and the vibratory plate against the ground and thereby increasing the spring preload. The problem described of self-propelled vibrating plates on cohesive soils does not arise with this device since the roller ensures sufficient propulsion.

Similar vehicles with attached soil compacting devices are known from DE 43 40 699 A1 and DE-A 20 46 840, where a plurality of vibratory plates or tampers are attached to a heavy travel drive.

U.S. Pat. No. 5,387,370 has disclosed an electroviscous fluid for dampers with variable damping properties, the change in damping being brought about by subjecting the electroviscous fluid to a suitable electric voltage.

U.S. Pat. No. 5,547,049 describes a construction with a magnetorheological fluid in which the damping properties of the fluid can be adjusted by varying an applied magnetic field.

OBJECTS AND SUMMARY OF THE INVENTION

The object on which the invention is based is to specify a soil compacting device in which the abovementioned problem of the device sinking in when temporarily crossing cohesive soils is avoided.

A soil compacting device according to the invention with an upper mass, a lower mass for soil compaction, a spring system coupling the upper mass and the lower mass, and with a damper system, which is arranged between the upper mass and the lower mass and interacts with the spring system, is distinguished by the fact that the damping properties of the damper system can be varied during the operation of the device. This makes it possible to vary the vibration properties and vibration behavior of the device and, for example, to adjust them in such a way that the amplitude of vibration is increased in such a way when crossing cohesive soil, for example, that the upper mass is induced to perform a resonance-type vibratory movement in order thereby to exert larger amplitudes and forces on the lower mass. The lower mass in this context is generally the actual base plate including the exciter by means of which the soil is compacted, while the upper mass is formed by the drive and the control system for the device.

By virtue of the fact that the vibration behavior can be varied during the operation of the device by means of the damping properties of a damper system provided for the partial or complete coupling of springs, the operator can cross the cohesive soil without interrupting his work. The damping properties can be adjusted manually or automatically, as defined in a number of the subsequent subclaims.

The forces on the lower mass generated by appropriate variation of the vibration properties (frequency, amplitude, direction of vibration) of the lower and the upper mass make it possible to overcome the increased sticking at the base plate caused by moist soils and associated with vibration and adhesion. The large amplitudes with an appropriately forward-directed force vector allow the device to execute a jumping movement, even on soils which are of low elasticity and are predominantly plastic.

In a particularly preferred embodiment of the invention, at least one damper of the damper system has a damping material composed of an electroviscous fluid. In the case of electroviscous fluids, the viscosity of the fluid can be varied under the action of electric voltage. This means that, depending on how the fluid is acted upon by an electric voltage, almost any viscosities and hence damping constants can be set at the damper. Dampers incorporating an electroviscous fluid are therefore particularly suitable for enabling the damping properties of the damper to be changed quickly during its operation. The response time of typical electroviscous fluids is around 3 milliseconds.

The damping properties of the damper system provided for intermittent or continuous coupling of spring systems can therefore advantageously be adjusted by subjecting the electroviscous fluid to a suitable electric voltage.

It can be particularly expedient if the electric voltage is clocked. This is particularly recommended when the vibration properties are adjusted by means of an automatic control system.

The electric voltage can additionally be adjusted to different levels.

However, it is also possible to vary the clocking, i.e. to change the lengths of time for applying voltage.

In a preferred embodiment of the invention, the electric voltage or clocking can be adjusted by means of an automatic control system. It is advantageous if the automatic control system has at least one sensor system.

It is particularly preferred if the sensor system has at least one acceleration sensor. If, namely, the base plate of the vibrating plate sinks into a soft soil or comes into contact with a soft soil, the reaction forces exerted by the soil on the plate change relative to the forces exerted by a firm underlying surface. In addition, there is a change in the frequency, amplitude and length of the jump of the lower mass and this can be detected by the acceleration sensor. When presettable limiting values are undershot, the sensor can give the signal that the contact area of the plate with soft soil is increasing at this moment or that it is already moving on said soil. This knowledge will then cause the automatic control system to alter the spring stiffness of the vibratory system and hence the vibration behavior accordingly by means of the damping constant of the damper in order to achieve the effects described above.

Instead of electroviscous fluids, it is also possible to use magnetorheological fluids, the viscosity of which changes as a function of an applied magnetic field. The magnetic field is then controlled and varied in a manner similar to the variation or clocking of the voltage in the case of electroviscous fluids.

Preferably, at least one spring of the spring system is arranged in parallel with a damper of the damper system. It can also be expedient if at least one spring of the spring system is arranged in series with a damper of the damper system. By appropriate arrangement of springs and dampers in the overall spring/damper system of the vibrating plate, it is thereby possible to define suitable spring characteristic regions within which the vibration properties can be varied. The interacting springs can have the same or different spring characteristics.

It can be particularly advantageous if the spring stiffness of the overall system is adjusted in such a way, by varying the damping constants, that the upper mass enters into resonant vibration during the operation of the device. This allows a maximum force effect at a large amplitude to be exerted on the lower mass in order to overcome the static friction with the soft underlying surface.

In a particularly preferred embodiment of the invention, at least one spring can be connected up or disconnected by means of a damper connected in series. This is possible by virtue of the fact that, at maximum stiffness, the damper completely activates the spring, while, given a correspondingly soft setting, it eliminates the effect of the spring.

The resultant direction of vibration of the upper mass can advantageously be controlled by connecting up and disconnecting one or more springs. Thus, for example, a resonant vibration of the upper mass can take place in a predetermined or controllable direction and hence expediently align the resultant force vector on the lower mass.

It is expedient if the lower mass or the upper mass is coupled to a vibration exciter by means of which the overall system has imparted to it the vibration required for soil compaction and movement of the vibrating plate.

In another embodiment of the invention, the upper mass is connected to the lower mass at four points, in each case by means of a spring/damper combination, the damping properties of the dampers being adjustable asymmetrically. Asymmetrical means that the dampers can assume different damping coefficients at each of the four points, making it possible, for example, to achieve an advantageous jumping movement of the lower mass, i.e. the base plate, for cohesive soils.

BRIEF DESCRIPTION OF THE DRAWINGS

The invention is explained in greater detail below with reference to the accompanying figures, in which.

DESCRIPTION OF THE PREFERRED EMBODIMENTS

Figure 1:
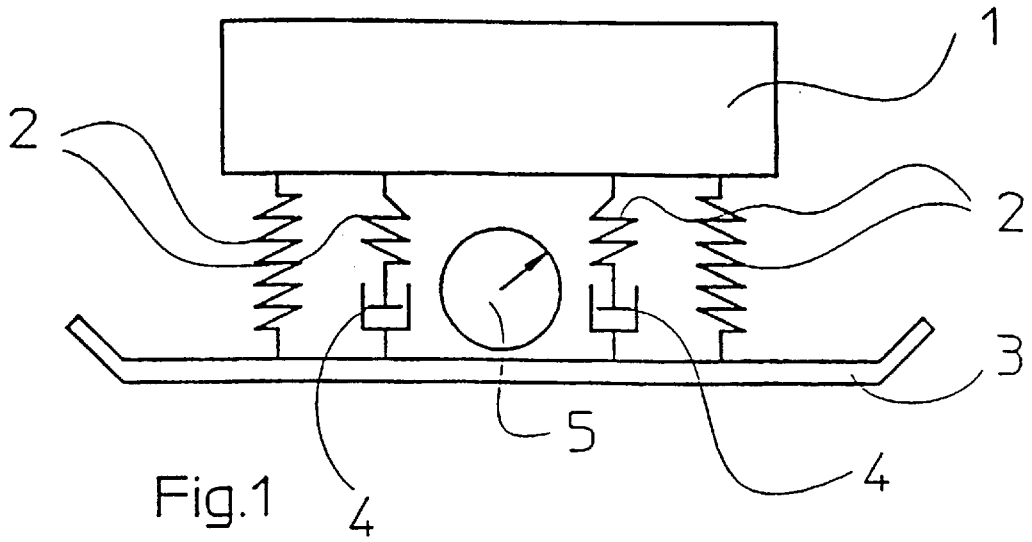
FIG. 1 shows the basic structure of a soil compacting device according to the invention.

FIG. 1 shows the basic structure of a vibrating plate according to the invention. The invention can, of course, also be employed with other soil compacting devices, e.g. with vibrating rollers or vibrating tampers.

An upper mass 1, which essentially accommodates the drive, is coupled by a spring system 2 to a lower mass 3 representing the base plate. The lower mass 3 rests flat on the soil to be compacted.

The lower mass 3 carries one or more vibration exciters known per se (not shown), which can also be moved in opposite directions for the purpose of forming directional vibrations. Depending on the construction of the vibrating plate, the vibration exciter has one or two shafts with unbalanced weights, which are driven by the motor belonging to the upper mass 1 via V-belts or a hydraulic system, for example, and, in the process, generate centrifugal forces. These dynamic forces bring about both the forward motion of the plate and its compacting action. The centrifugal forces produced are always well above the deadweight of the vibrating plate, with the result that the entire unit is briefly raised a few millimeters above the ground and moved along every time the unbalanced weights rotate. The plate then reaccelerates back to the ground and acts with a brief, high surface pressure on the material to be compacted with the kinetic energy built up and the centrifugal force produced in the exciter.

Arranged between the upper mass 1 and the lower mass 3 there is furthermore a damper system 4 which interacts with the spring system 2 and forms an overall vibratory system with the masses 1, 3.

Figure 2:
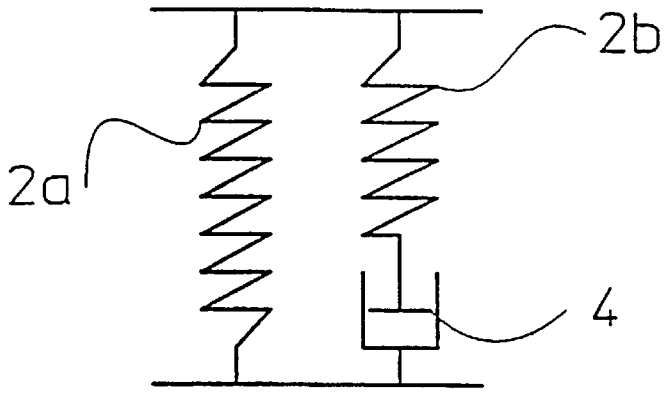
FIGS. 2 and 3 show suitable arrangements of spring and damper elements.

The spring system 2 comprises a plurality of springs connected in parallel or in series and composed, for example, of metal or rubber-metal elements, pneumatic springs or other flexible materials, which are connected to one another by dampers of the damper system 4. Expedient arrangements of springs 2 and dampers 4 are illustrated in FIGS. 2 and 3.

Since the damping properties of the damper system 4 and hence of the individual dampers can be varied during the operation of the device, it is possible to set very different characteristic curves for the overall vibratory system. Assuming that the damper 4 in FIG. 2 is set so as to be extremely hard, it can be seen that the two springs 2*a*, 2*b* illustrated are connected in parallel and that their spring constants are added together. If, on the other hand, the damper 4 is set so as to be extremely soft, spring 2*b* loses its effect in the overall vibratory system and the system is thus determined by spring 2*a* alone.

Figure 3:
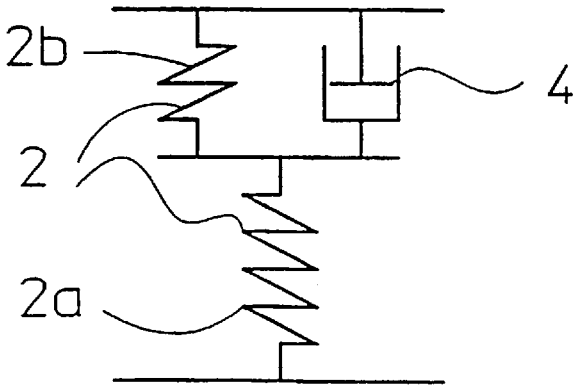

Similar remarks can be made regarding the connection of spring elements in series in accordance with FIG. 3.

The damper systems respond extremely rapidly to appropriate activation (within 3 milliseconds) and comprise reciprocating cylinders which are filled with electroviscous fluid and the damping constant of which can be varied over extremely wide ranges by clocking an applied high voltage which is, in addition, variable. The extreme states of these damper elements lie between no damping, i.e. rigid transmission of the forces introduced, to 100% damping, whereby the forces introduced are transmitted virtually not at all but instead are absorbed during the working displacement of the damper.

A sensor 5 which continuously measures the acceleration of the lower mass 3 is mounted on the lower mass 3. When the vibrating plate is passed over a piece of ground with a tendency to adhesion or vibratory penetration, the vibration behavior changes as it approaches this piece of ground, i.e. the amplitude of the base plate, (lower mass 3) changes because the softer ground exerts different reaction forces on the plate than a hard underlying surface and the forward acceleration decreases. This change is detected by the acceleration sensor 5 and indicated to a control unit (not shown) which, in turn, adjusts the viscosity in the damper system 4 by suitable voltage control and/or clocking of high voltage. As a result, in accordance with the invention the resonant frequency of the vibratory system is adjusted to the range of the excitation frequency, thereby resulting in different modes of vibration, all characterized by high amplitudes, depending on the eigenform excited. The large-amplitude vibration which now results can be directed in such a way by appropriate choice of frequency and mounting of the spring and damper elements that it exerts maximum force vectors on the lower mass and thereby helps to release the lower mass 3 from the ground.

Depending on the embodiment, the automatic control system activates just one damper member in the overall system or a plurality of dampers. If a plurality of dampers are activated, they can be adjusted to the same damping constant or—if expedient in the given application—to different damping constants. The person skilled in the art can decide here what outlay is necessary and appropriate for the configuration of the automatic control system. It may be possible to achieve the desired effect according to the invention by activating just one damper.

In the control unit, the acceleration value for the base plate detected by the acceleration sensor 5 is compared with preset desired values. If it is found that the base plate does not achieve the required acceleration patterns, the control unit concludes that the vibrating plate is on a problematic underlying surface. The control unit then controls the viscosity in the connected damper elements of the damper system 4 in accordance with predetermined characteristics.

Instead of automatic control, it is possible for the operator to adjust the vibration behavior of the soil compacting device as a function of the underlying surface which is being crossed at that particular time, using control elements (not shown). Thus, for example, it is possible for a switch to be provided, which is to be actuated by the operator when he notices that the base plate is sticking on soft ground. When the switch is actuated, a corresponding damper system with electroviscous damper elements is then activated and the upper mass is adjusted to resonance of a suitable eigenform. Once the critical ground has been crossed, the operator switches the switch off again, whereupon the device reattains its normal operating state.

There is a significant advantage over the prior art in the control behavior of the vibrating plate since, previously, it was only possible to adapt or adjust the vibrating plate approximately to the ground to be compacted by configuration of the entire vibratory system of the vibrating plate and hence only by permanent presetting. In this arrangement, it was hitherto impossible to adjust the soil compacting device equally well to two different types of soil (noncohesive and moist/cohesive soils).

Examples of suitable electroviscous or electrorheological fluids are RHEOBAY® products. With these fluids, the shear stress that can be used for force transmission, and hence the dynamic viscosity, is raised within milliseconds by applying an electric field. When the voltage is switched off, the original viscosity is restored. The field strength to be applied is preferably between 0 and 3 kV/mm. Both D.C. and A.C. voltages can be applied. The voltage applied can be clocked and achieve pulse widths between 0 and 100%.

What is claimed is:

1. A soil compacting device with an upper mass (1);

a lower mass (3) for soil compaction;

a spring system (2) coupling the upper mass and the lower mass; and with a damper system (4), which is arranged between the upper mass and the lower mass and interacts with the spring system;

a control system that actively varies damping properties of the damper system (4) during operation of the device.

2. The soil compacting device as claimed in claim 1, wherein at least one damper of the damper system (4) has a damping material composed of an electroviscous or magnetorheological fluid.

3. The soil compacting device as claimed in claim 2, wherein the control system actively varies the damping properties of the damper system (4) by subjecting the electroviscous fluid to a suitable electric voltage or subjecting the magnetorheological fluid to a suitable magnetic field.

4. The soil compacting device as claimed in claim 3, wherein the electric voltage is clocked.

5. The soil compacting device as claimed in claim 4, wherein the control system is an automatic control system that adjust the electric voltage or clocking.

6. The soil compacting device as claimed in claim 5, wherein the automatic control system has at least one sensor system (5).

7. The soil compacting device as claimed in claim 6, wherein the sensor system has at least one acceleration sensor (5).

8. The soil compacting device as claimed in claim 3, wherein the electric voltage can be adjusted to various values.

9. The soil compacting device as claimed in claim 4, wherein the clocking of the voltage is variable.

10. The soil compacting device as claimed in claim 1, wherein at least one spring of the spring system (2) is arranged in parallel with a damper of the damper system (4).

11. The soil compacting device as claimed in claim 10, wherein at least two springs (2*a*, 2*b*), which have the same or different spring characteristics, interact with the damper system (4).

12. The soil compacting device as claimed in claim 1, wherein at least one spring of the spring system (2) is arranged in series with a damper of the damper system (4).

13. The soil compacting device as claimed in claim 1, wherein the control system actively varies the damping properties in such a way that the upper mass (1) goes into resonant vibration during the operation of the device.

14. The soil compacting device as claimed in claim 1, wherein at least one spring of the spring system (2) can be connected up or disconnected by means of a damper of the damper system (4) connected in series.

15. Soil compacting device as claimed in claim 1, wherein the upper mass (1) is connected to the lower mass (3) at four points, in each case via a respective spring system and a respective damper system, and wherein the damping properties of the dampers can be adjusted asymmetrically.

16. The soil compacting device as claimed in claim 1, wherein the lower mass (3) is coupled to a vibration exciter.

* * * * *